US005570550A

United States Patent [19]

Roby

[11] Patent Number: 5,570,550

[45] **Date of Patent: *Nov. 5, 1996**

[54] INSULATED WALL CONSTRUCTION

[76] Inventor: Edward F. Roby, 4480 S. Tiffany Dr., West Palm Beach, Fla. 33407

[ * ] Notice: The term of this patent shall not extend beyond the expiration date of Pat. No. 5,107,648.

[21] Appl. No.: 104,091

[22] PCT Filed: Feb. 13, 1992

[86] PCT No.: PCT/US92/00858

§ 371 Date: Aug. 17, 1993

§ 102(e) Date: Aug. 17, 1993

[87] PCT Pub. No.: WO92/14890

PCT Pub. Date: Sep. 3, 1992

Related U.S. Application Data

[63] Continuation of Ser. No. 687,418, Feb. 19, 1991, Pat. No. 5,107,648.

[51] Int. Cl.[6] ..... E04B 1/18

[52] U.S. Cl. ..... 52/309.12; 52/426; 52/564; 52/699

[58] Field of Search ..... 249/190, 191, 249/213, 216; 52/562, 564, 426, 309.12, 428, 699

[56] References Cited

U.S. PATENT DOCUMENTS

| | | | |
|---|---|---|---|
| 1,820,509 | 8/1931 | Toogood | 249/216 |
| 3,985,329 | 10/1976 | Liedgens | 249/216 |

*Primary Examiner*—Creighton Smith

[57] ABSTRACT

An insulated wall construction is provided utilizing spaced planar rigid foam plates, each foam plate including an upstanding rib formed about an upper and forward edge of each section, with a complimentary groove formed through each rear and bottom edge of each section. The construction includes a spacer rod positioned medially of the sections, the spacer rod receivable within a rod support, the rod support fixedly secured orthogonally to an external support plate, wherein the rod is directed through each section to receive the spaced rod therewithin. The spacer rod includes a plurality of apertures between each lock pin and capture an internal support plate between each lock pin and each interior space of each section. A temporary support member is provided to provide support to stacked sections for reception of concrete between the spaced sections to permit curing of concrete in a fixed orientation.

5 Claims, 6 Drawing Sheets

PRIOR ART

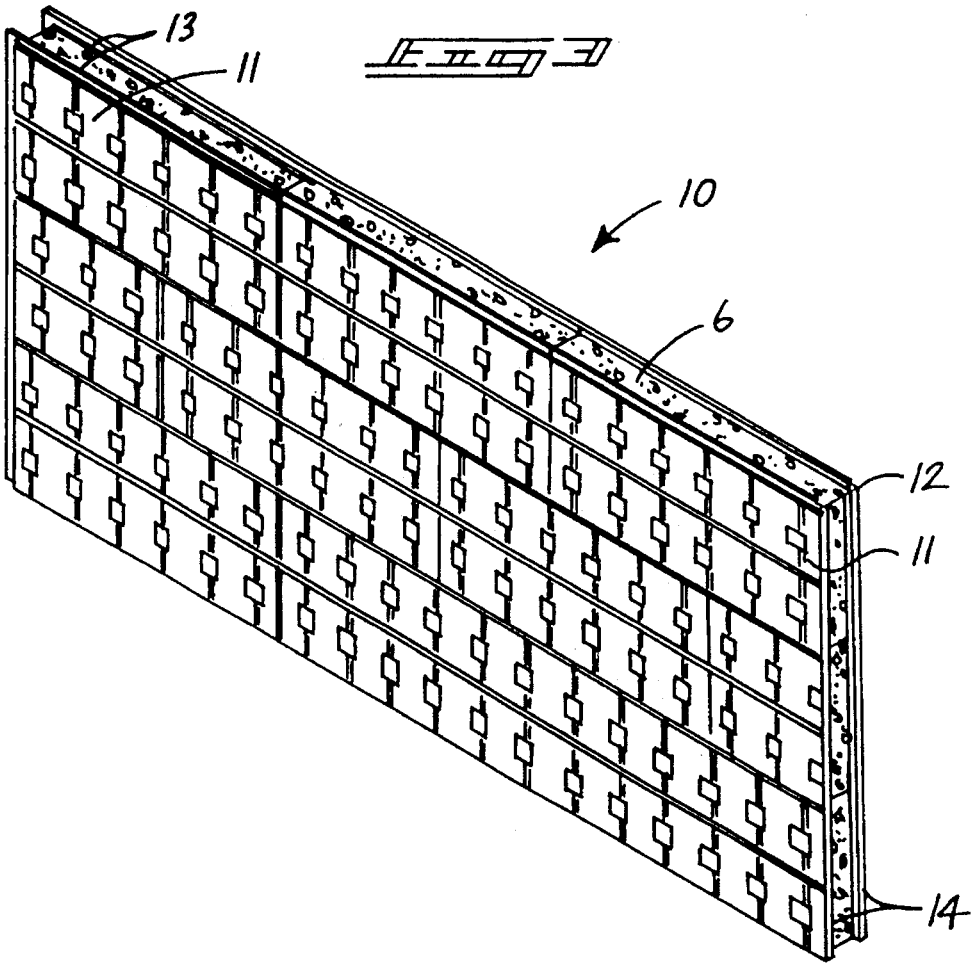
Fig 3
Fig 4
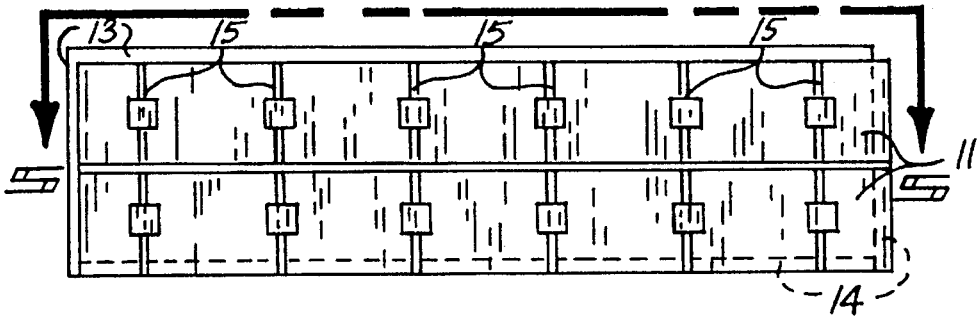
Fig 5
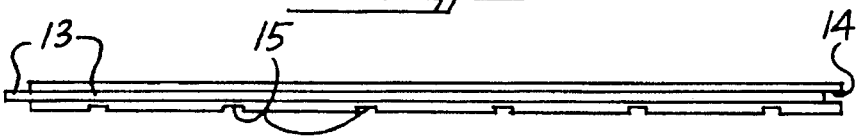

Fig 6
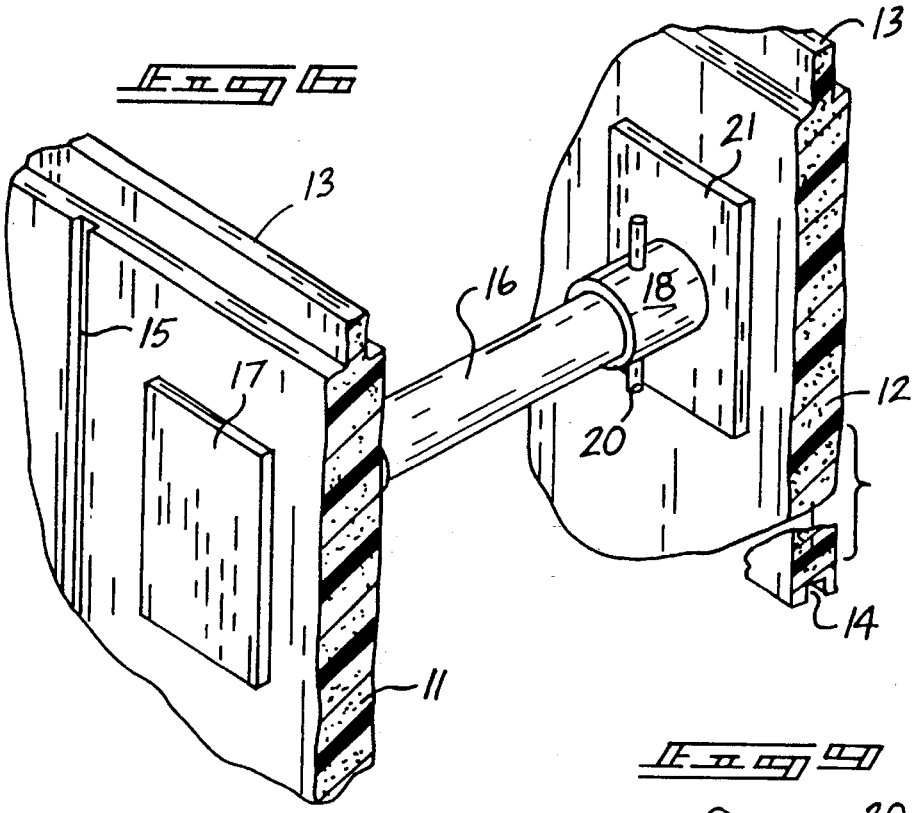
Fig 9
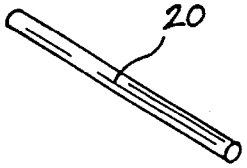
Fig 7
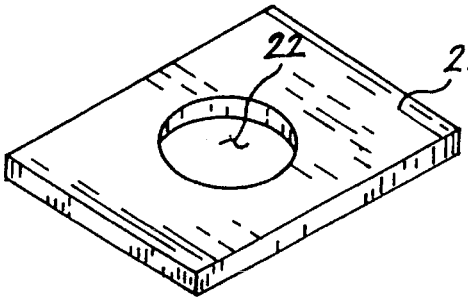
Fig 10
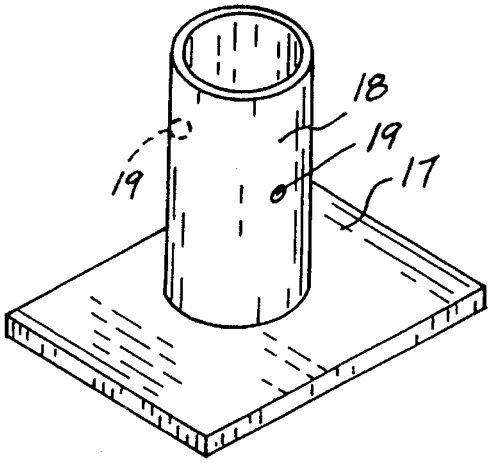
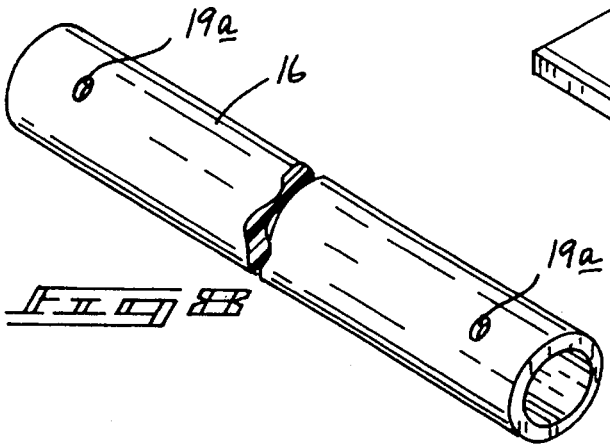
Fig 8B

INSULATED WALL CONSTRUCTION

RELATED APPLICATION

The present application is a continuation of applicant's prior application Ser. No. 07/657,418, filed Feb. 19, 1991, now U.S. Pat. No. 5,107,648.

TECHNICAL FIELD

The field of invention relates to insulated wall construction, and more particularly pertains to a new and improved insulated wall construction wherein the same utilizes semi-rigid foam section plates fixedly spaced apart relative to one another to receive concrete directed therebetween.

BACKGROUND ART

The use of insulated composite concrete walls utilizing relatively planar structure insulative sheet as concrete forms have been utilized in the prior art. Heretofore, the construction and assembly of such units have been of a relatively complex and unnecessarily cumbersome organization to permit rapid erection and deployment throughout a building site. The instant invention attempts to overcome deficiencies of the prior art by providing a readily assembled and integral unit that accommodates finishing securement of sheet rock panels, as well as the accommodation of various thicknesses of poured concrete in a "green" state directed within the cavity defined between the planar insulated sheets. Examples of prior art structures include U.S. Pat. No. 4,750,308 to McKay setting forth an insulated wall construction utilizing spaced planar foam sheets with sheet metal plates secured together by twisted tie rods defined as an integral unit, wherein the central unit is preconstructed and slid within recesses formed within the sheet, as opposed to the instant invention permitting subsequent assembly of the medial unit subsequent to positioning of the spaced sheet-like sections.

U.S. Pat. No. 4,604,843 to Ott, et al. sets forth a concrete framework utilizing foam material secured together by a ladder-like medial member of integral construction.

U.S. Pat. No. 4,706,429 to Young sets forth a form construction utilizing spaced concrete forming panels secured together by a cross tie rod relationship.

U.S. Pat. No. 4,742,659 to Meilleur utilizes a series of plastic foam modules disposed in a secured relationship utilizing a matrix of cross links to secure the modules together in a both lateral and vertical orientation relative to the modules.

U.S. Pat. No. 4,698,947 to McKay sets forth a further example of securing spaced foam panels together utilizing an integral medial support member interfitted within a slot structure within the spaced panels.

As such, it may be appreciated that there continues to be a need for a new and improved insulated wall construction wherein the same addresses both the problems of ease of use as well as effectiveness in construction in accommodating poured concrete medially of spaced planar sheets permitting on-site immediate erection of such wall sections and in this respect, the present invention substantially fulfills this need.

DISCLOSURE OF INVENTION

In view of the foregoing disadvantages inherent in the known types of insulated wall constructions now present in the prior art, the present invention provides an insulated wall construction wherein the same utilizes spaced planar foam sheet members utilizing spaced positioning units mounted an equal distance throughout the wall construction to maintain the planar panels in a fixed relationship, as well as providing support for covering material such as sheet rock, stucco, and the like. As such, the general purpose of the present invention, which will be described subsequently in greater detail, is to provide anew and improved insulated wall construction which has all the advantages of the prior art insulated wall constructions and none of the disadvantages.

To attain this, the present invention includes an insulated wall construction utilizing spaced planar foam plates, each foam plate including an upstanding rib formed about an upper and forward edge of each section, with a complementary groove formed through each rear and bottom edge of each section. The construction includes a spacer rod positioned medially of the sections, the spacer rod receivable within a rod support, the rod support fixedly secured orthogonally to an external support plate, wherein the rod is directed through each section to receive the spacer rod therewithin. The spacer rod includes a plurality of apertures to receive a lock pin and capture an internal support plate between each lock pin and each interior space of each section. A support member is provided to provide support to stacked sections for reception of concrete between the space sections to permit curing of concrete in a fixed orientation.

It is therefore an object of the present invention to provide a new and improved insulated wall construction which has all the advantages of the prior art insulated wall construction and none of the disadvantages.

It is another object of the present invention to provide a new and improved insulated wall construction which may be easily and efficiently manufactured and marketed.

It is a further object of the present invention to provide a new and improved insulated wall construction which is of a durable and reliable construction.

An even further object of the present invention is to provide a new and improved insulated wall construction which is susceptible of a low cost of manufacture with regard to both materials and labor, and which accordingly is then susceptible of low prices of sale to the consuming public, thereby making such insulated wall constructions economically available to the buying public.

Still yet another object of the present invention is to provide a new and improved insulated wall construction which provides in the apparatuses and methods of the prior art some of the advantages thereof, while simultaneously overcoming some of the disadvantages normally associated therewith.

Still another object of the present invention is to provide a new and improved insulated wall construction wherein the same permits on-site erection and fabrication of wall units accommodating poured concrete therewithin.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an isometric illustration of the instant invention utilizing a matrix of wall units secured together to receive poured concrete therebetween.

FIG. 4 is an orthographic frontal view, taken in elevation, of a plurality of wall units utilized by the instant invention.

FIG. 5 is an orthographic view, taken along the lines 5—5 of FIG. 4 in the direction indicated by the arrows.

FIG. 6 is an isometric illustration of a support structure utilized by the instant invention between spaced planar foam panels.

FIG. 7 is an isometric illustration of an internal support plate utilized by the instant invention.

FIG. 8 is an isometric illustration of a support rod utilized by the instant invention.

FIG. 9 is an isometric illustration of a lock pin utilized by the instant invention.

FIG. 10 is an isometric illustration of an external support plate and supporting rod utilized by the instant invention.

BEST MODE FOR CARRYING OUT THE INVENTION

Figure 1:
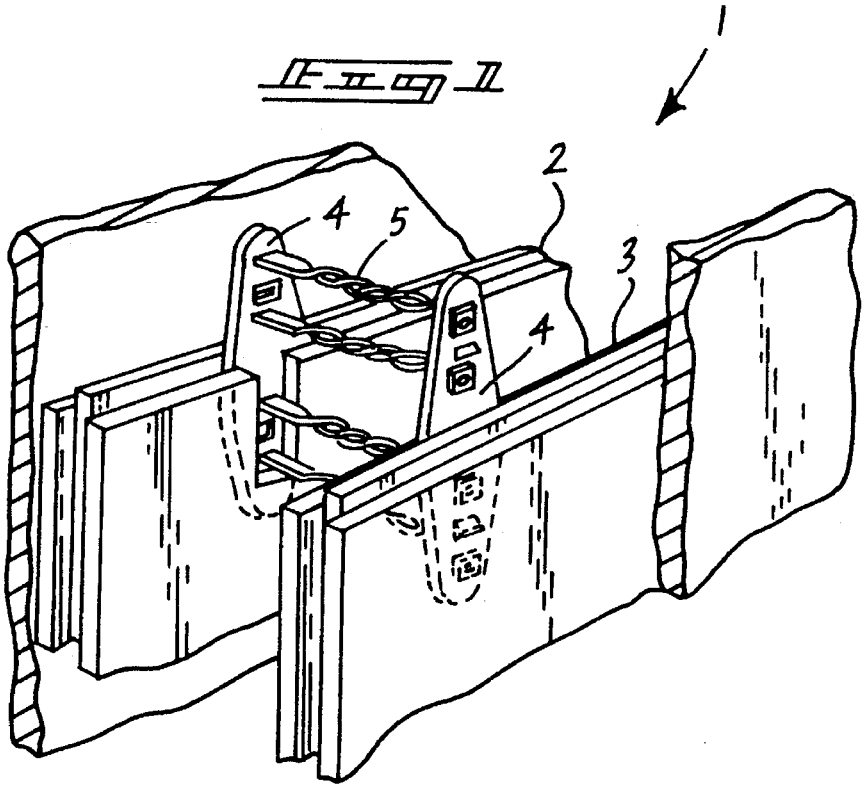
FIG. 1 is an isometric illustration of a prior art insulated wall construction.
Figure 2:
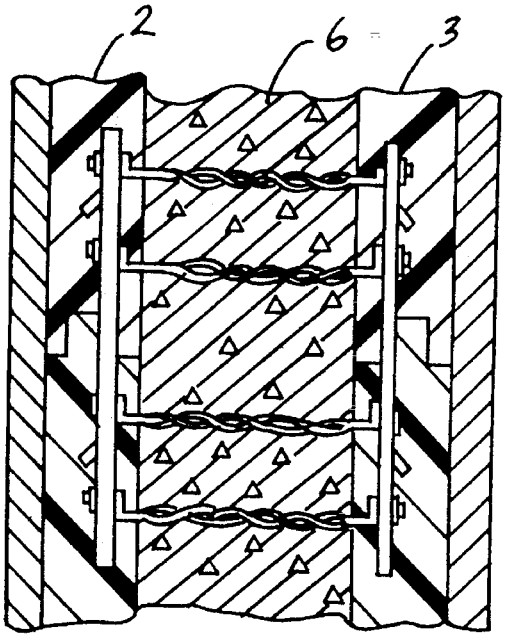
PRIOR ART Fig 2
FIG. 2 is an orthographic top view of the prior art construction, as illustrated in FIG. 1.
Figure 11:
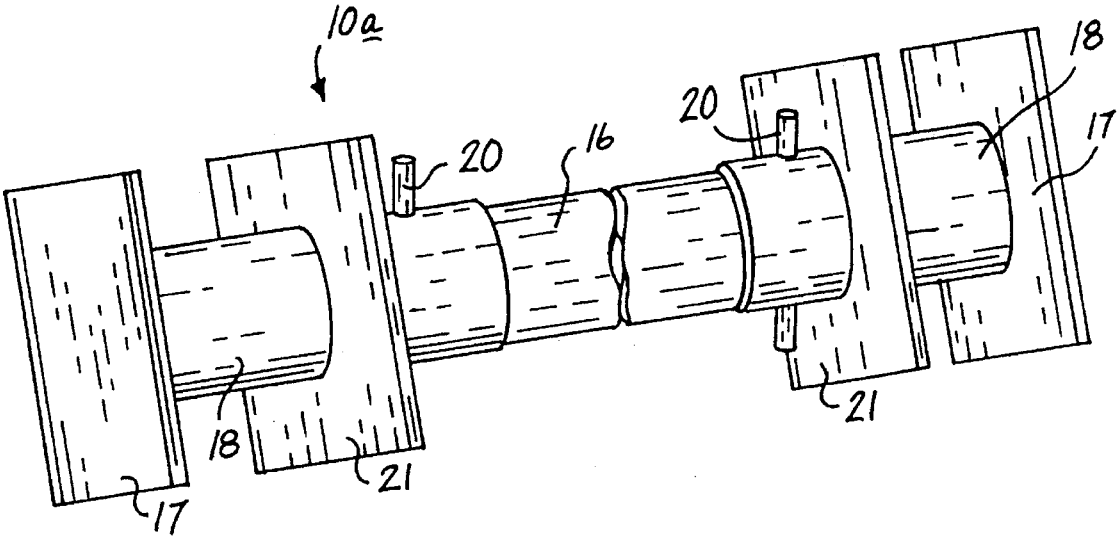
FIG. 11 is an isometric illustration of the support unit utilized by the instant invention.

With reference now to the drawings, and in particular to FIGS. 1 through 22 thereof, a new and improved insulated wall construction embodying the principles and concepts of the present invention and generally designated by the reference numerals 10, 30, and 40 will be described.

FIG. 1 illustrates a prior art device 1, wherein spaced planar foam panels 2 and 3 utilize a medial unit, including spaced sheet metal members 4 secured together by twist rods 5 defining a unit that is received within slots within the panels to accommodate poured concrete 6 (see FIG. 2) to define a wall structure.

More specifically, the insulated wall construction 10 of the instant invention essentially comprises a first foamed panel section 11 spaced from and parallel to a second foamed panel section 12. Each foamed panel section is of conventional construction having insulating properties as is well known in the art and includes an elongate ribbed member 13 integrally formed to a top and forward edge of each panel section complementarily received within an elongate groove 14 formed through each rear and bottom edge of each panel section to permit interlocking of the panel section together, in a relationship as illustrated in FIG. 3 for example, to accommodate concrete 6 poured and directed therebetween. Further, optional vertical drainage grooves 15 arranged in a parallel vertical relationship at spacing along exterior faces of each panel section are formed to permit drainage when the panel sections are utilized in a below-ground construction forum, such as in foundations and the like. To secure the first and second panel sections together in a predetermined relationship at a predetermined spacing therebetween, support units 10*a* (see FIG. 11) are provided. The support units are positioned orthogonally relative to each panel section at predetermined spacings. For example, to accommodate various building codes, sixteen inch spacings are typically utilized, but it is understood that various spacings to accommodate various codes and the like may be provided. The support units each include a spacer rod 16 (see FIGS. 6, 8, and 11) wherein the spacer rods are provided in various lengths to effect wall construction of various widths, dependent upon building code and construction requirements. Each support unit includes an external support plate 17, each support plate 17 includes an external support plate rod support 18, each rod support 18 is integrally and orthogonally mounted to an interior surface of each support plate, wherein each rod support is defined by a predetermined length greater than a predetermined thickness of each panel section to direct each rod support through each panel section in an orthogonal relationship. It is understood that each rod support 18 directed through each panel section is in a coaxially aligned relationship to receive the spacer tube between opposed tube supports 18, as illustrated in FIG. 6 for example. Each rod support is defined by an internal rod support diameter substantially equal to an external diameter defined by each spacer rod. Further, each rod support includes aligned locating bores 19 spaced from an internal surface of each support plate, in a manner as illustrated in FIG. 10, to receive a lock pin 20 therethrough. The lock pin 20 is directed through each pair of aligned rod supports locating bores 19, as well as aligned locating bores directed adjacent each end of each spacer rod to thereby lock each spacer rod within each rod support 18, in a manner as illustrated in FIG. 6. It is understood that the spacer rod locating bores 19*a*, as well as the rod support locating bores 19, are arranged in alignment orthogonally oriented relative to each axis defined by the rod support 18 and the spacer rod 16 respectively. An inner support plate 21 is captured between each lock pin 20 and each internal surface of each panel section 11 and 12 to provide support and reinforcement for each panel section. Each inner support plate 21 includes an inner support plate opening 22 defined by an inner support plate opening diameter substantially equal to an external diameter defined by each red support 18. The external surface of each external support plate accordingly accommodates securement of various coverings, such as gypsum board, stucco, and the like, providing anchoring therefore. For example, gypsum board may be secured utilizing self-tapping sheet metal screws to accordingly fixedly secure such covering to each external surface of each external support plate 17. It is understood that subsequent to the pouring of the concrete 6 between the interior surfaces of the first and second panel sections 11 and 12, the covering such as gypsum board is secured providing superior insulative qualities to the finished wall construction. Also, the tubular construction of the spacer tubes 16 and the associated rod support 18 provide limited resistance to the pouring of concrete between the spaced panel sections limiting the occurrence of voids within the concrete.

As required, a reinforcing bar may be positioned in overlying relationship to the spacer tubes to provide convenient positioning and securement of the reinforcing bar if such is deemed necessary.

Figure 12:
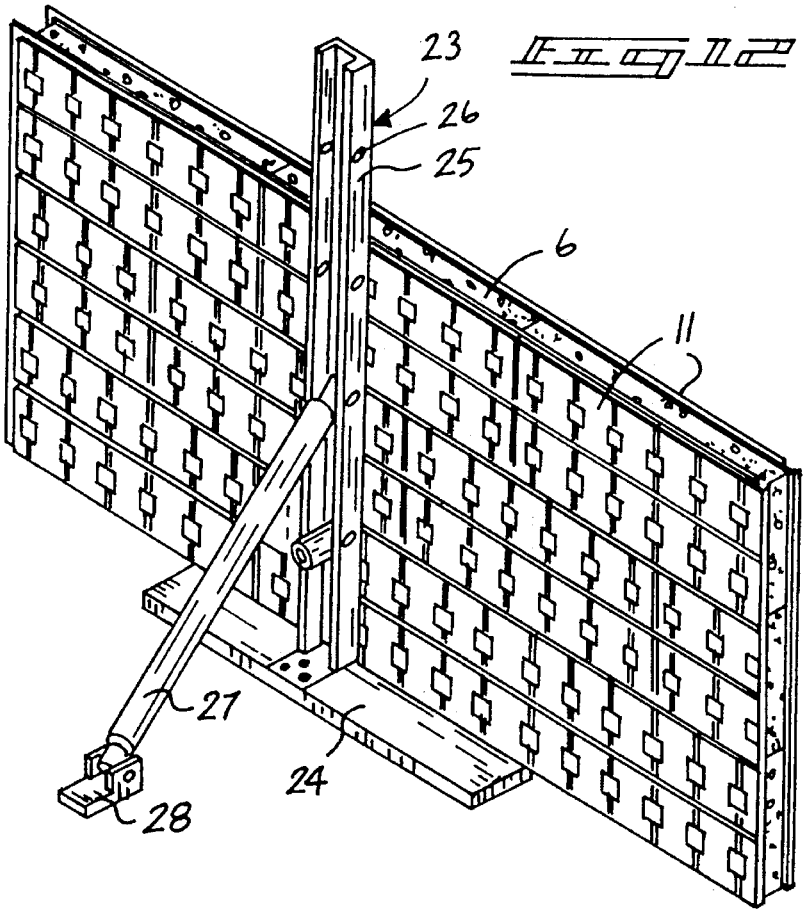
FIG. 12 is an isometric illustration of a wall unit and support member utilized by the instant invention.
Figure 13:
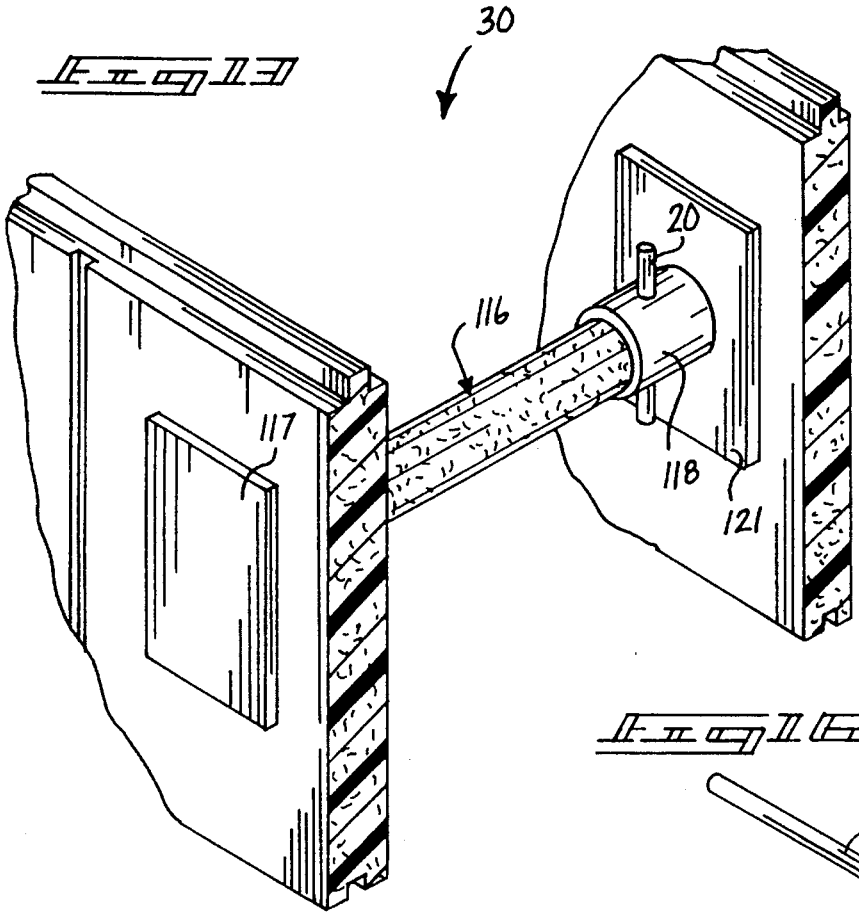
FIG. 13 is an isometric illustration of a modified organization of the instant invention.
Figure 16:
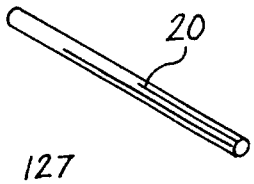
FIG. 16 is an isometric illustration of a lock pin utilized by the invention.
Figure 14:
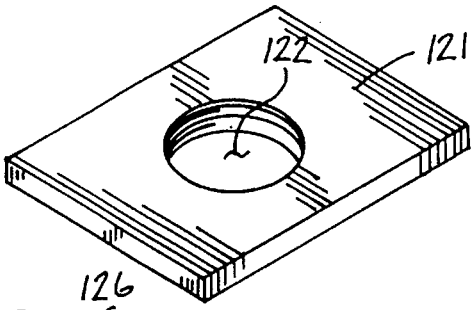
FIG. 14 is an isometric illustration of a modified inner support plate utilized by the instant invention.
Figure 17:
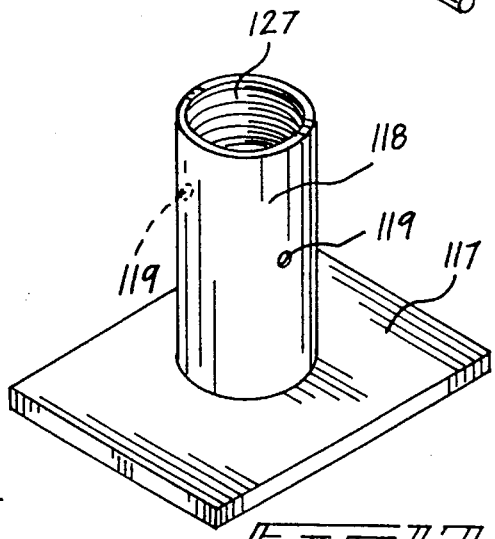
FIG. 17 is an isometric illustration of an external modified support plate and tube utilized by the instant invention.
Figure 15:
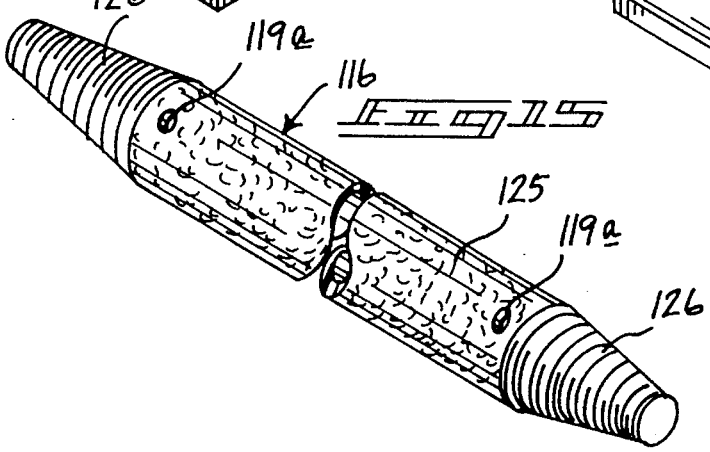
FIG. 15 is an isometric illustration of a support rod utilized by the instant invention.

Reference to FIG. 12 illustrates the use of a support member 23, wherein the support member includes a base plate 24 positionable adjacent a matrix of the first and second panel sections and their associated support units secured together to accommodate concrete 6 poured therebetween. The base plate 24 includes a "U" shaped channel 25 fixedly and orthogonally mounted to a top surface of the base plate adjacent a forward edge of the base plate to provide support vertically to the column of panel sections. The "U" shaped channel receives an upper end of a support rod 27 that is secured between a "U" shaped channel 25 by aligned opening pairs 26 cooperative with openings formed within the support rod 27. A lower terminal end of the support rod 27 is secured to a foot member 28 to triangulate the support rod and provide support to the wall construction, as illustrated in FIG. 12, during curing of the concrete 6.

Figure 18:
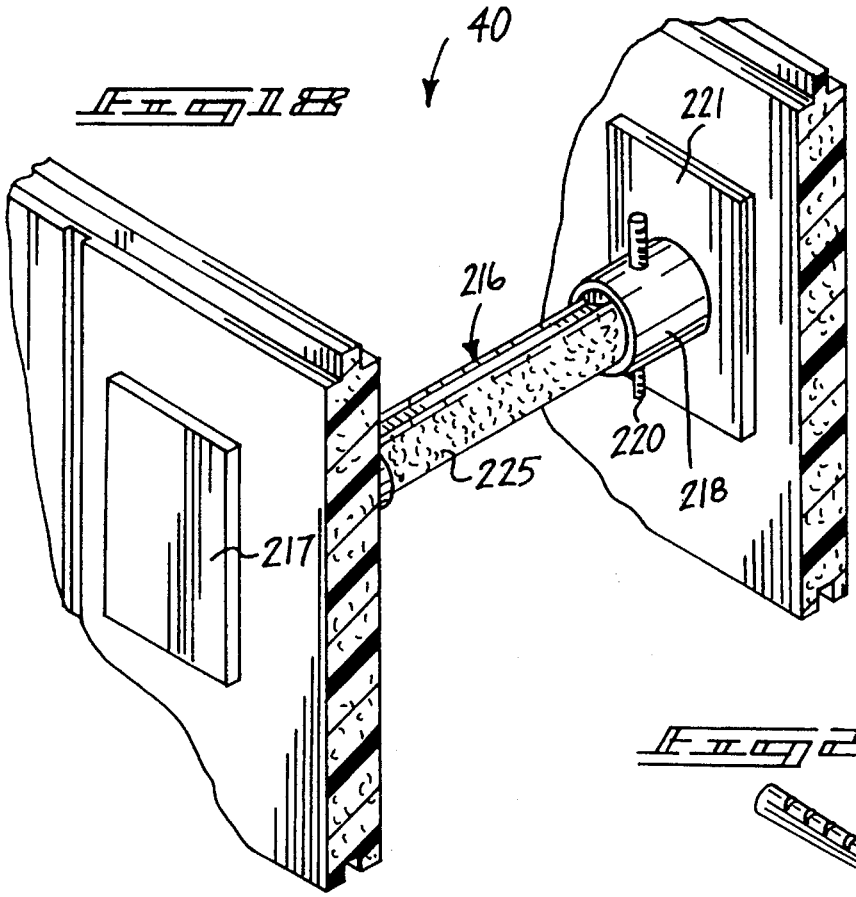
FIG. 18 is an isometric illustration of a yet further modified support structure utilized by the instant invention.
Figure 21:
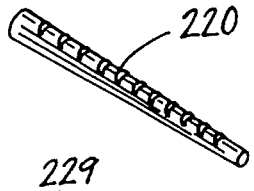
FIG. 21 is an isometric illustration of a modified lock pin utilized by the instant invention.
Figure 19:
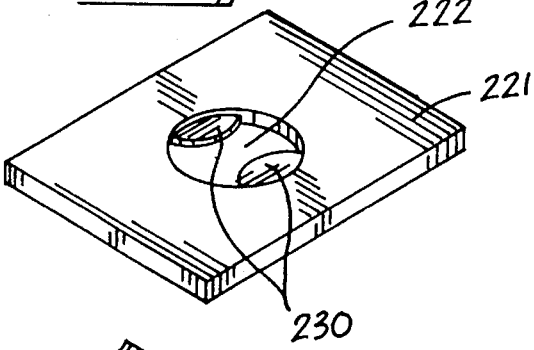
FIG. 19 is an isometric illustration of a further modified internal support plate utilized by the instant invention.
Figure 22:
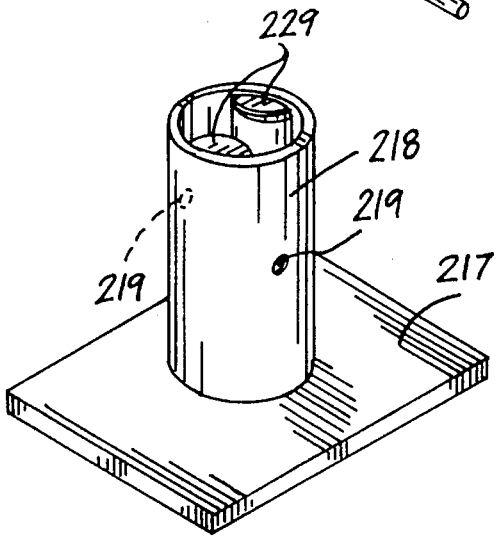
FIG. 22 is an isometric illustration of a further modified external support plate and tube utilized by the instant invention.
Figure 20:
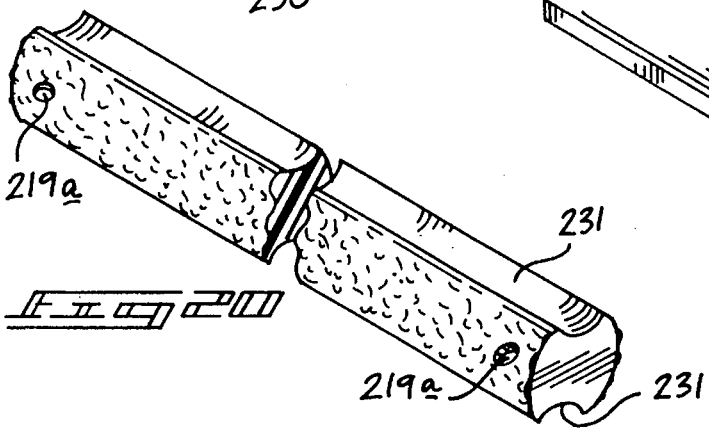
FIG. 20 is an isometric illustration of a further modified support rod utilized by the instant invention.

The modified support organization 30, as illustrated in FIGS. 13–17, includes a modified spacer rod 116, including an external cylindrical surface 125 formed with externally threaded terminal end portions 126 at each terminal end thereof threadedly receivable within internally threaded inner support openings 122 and internally threaded support tube surface 127 of each tube support 118 that is fixedly mounted to an external support plate 117. Locating bores 119 are diametrically aligned within the tube support 118 for registration with the spacer tube locating bores **119*a* diametrically directed through each reference cylindrical surface 125 adjacent each externally threaded terminal end portion 126 to permit threaded mounting of the modified spacer rod 116 in an assembled configuration relative to the modified tube support 118 and the internally threaded support plate 121. Similarly, the further modified organization 40, as illustrated in FIGS. 18–20, utilizes a further modified spacer rod 216 that includes an externally threaded external surface utilizing diametrically opposed flutes 231 of a generally semi-cylindrical configuration formed on diametrically opposed sides of each further modified spacer rod 216. The further modified internal support plates 221 utilize a modified inner support plate opening 222 that includes diametrically opposed semi-cylindrical planar projections 230 that are in planar alignment relative to one another and extend in diametrically opposed relationship relative to one another to be received within the opposed flutes 231. The use of a further modified tube support 218 includes a plurality of diametrically opposed semi-cylindrical projections 229 that are coextensively directed through the inner surface of each further modified tube support 218 to receive the flutes 231. The further modified locating bores 219 are directed through the further modified tube support 219 for alignment with further modified spacer tube locating bores 219*a* to receive a further modified lock pin 220. The lock pin 220 includes a conical configuration formed with a stepped exterior surface to enhance securement of the lock pin 220** within the associated locating bores.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An insulated wall construction apparatus comprising the combination of:

first and second rod supports, each said rod support comprising a plate (17) and a rod support member (18) extending orthogonally from said plate, said plate having a transverse extent, said rod support member having a transverse cross-sectional dimension less than the transverse extent of said plate whereby said plate serves as a flange located at a first end of said rod support member, each said rod support member having a central bore and an opening for said central bore at a second end of said support member opposite to said plate and a pair of aligned apertures extending orthogonally through each said rod support member, said aligned apertures being located intermedially of said rod support member between said plate and said central bore opening;

a spacer rod (16), said spacer rod being of predetermined axial extent and having a pair of opposed ends each of which is adapted to be received axially into a corresponding one of said central bore openings of said rod support members, said spacer rod further having a pair of axially spaced openings extending orthogonally therethrough, each of said spaced openings being adapted to align with said pair of aligned apertures in a corresponding rod support member when said spacer rod ends are received through said central bore openings, respectively;

a pair of locking pin members, each of said locking pin members being adapted to be orthogonally inserted through a corresponding pair of said aligned apertures on said rod support member and one of said axially spaced openings on said spacer rod aligned therewith when said spacer rod is received through said bore opening in said second end of said corresponding rod support member, and locating means for aligning at least one of said axially spaced openings extending orthogonally through said spacer rod with at least one of said pairs of aligned apertures extending orthogonally through each said rod support member when said spacer rod is received through said corresponding central bore opening.

2. The apparatus defined in claim 1 wherein at least one of said rod support member's central bore opening defines an interior therein, said spacer rod has an exterior surface, said locating means comprises a pair of diametrically opposed locating members (229) extending axially along the interior defined by the central bore of said at least one of said rod support members and at least the spacer rod end insertable into said interior thereof through said central bore opening includes a pair of complementarily shaped indentations (231) extending axially along the exterior surface of said spacer rod whereby engagement between said locating members and said indentations is adapted to align said pair of aligned apertures in said at least one rod support member with one opening of said pair of axially spaced openings in said spacer rod when the spacer rod is inserted into said interior.

3. The apparatus defined in claim 1 wherein said pair of aligned apertures in at least one of said rod support members is adapted to extend through a corresponding pair of diametrically opposed locating members and said pair of complementarily shaped indentations engaged therewith when said spacer rod is inserted into said interior through said opening of said central bore.

4. The apparatus defined in claim 1 further including first and second auxiliary support plates (21), each of said auxiliary support plates having a central opening at least as large as the transverse cross-sectional dimension of each of said rod support members for receiving therethrough a corresponding one of said first or second rod support members such that each said auxiliary support plate is adapted to be orthogonally positioned on its corresponding rod support member between said plate and said pair of aligned apertures.

5. The apparatus defined in claim 1 further in combination with a pair of planar insulation panels, said insulation panels adapted to be spaced apart from each other, each said panel having first and second opposed sides whereby said pair of spaced apart planar insulation panels defines a pair of outwardly facing sides and a pair of inwardly facing sides confronting each other, each of said pair of spaced apart insulation panels having a hole therethrough such that said holes are aligned in a confronting manner, each of said holes being sized to receive a corresponding one of said rod support members in an orthogonal relation to each panel with the plate of each rod support being adapted to bear in an abutting manner against the outwardly facing side of a corresponding panel and the the central bore openings of the rod support members being spaced apart between said inwardly facing sides of said panels to receive said spacer rod therein such that concrete poured between said inwardly facing sides of said insulated panel to form an integral wall comprising said panels, said concrete, said rod support members and said spacer rod.

* * * * *